US012268928B2

(12) United States Patent
Drake

(10) Patent No.: US 12,268,928 B2
(45) Date of Patent: Apr. 8, 2025

(54) NECK STRENGTHENING DEVICE

(71) Applicant: Aaron Drake, Denver, CO (US)

(72) Inventor: Aaron Drake, Denver, CO (US)

( * ) Notice: Subject to any disclaimer, the term of this patent is extended or adjusted under 35 U.S.C. 154(b) by 145 days.

(21) Appl. No.: 17/816,383

(22) Filed: Jul. 29, 2022

(65) Prior Publication Data

US 2024/0033565 A1 Feb. 1, 2024

(51) Int. Cl.
*A63B 23/025* (2006.01)
*A63B 21/00* (2006.01)

(52) U.S. Cl.
CPC ..... *A63B 23/025* (2013.01); *A63B 21/4003* (2015.10); *A63B 21/4039* (2015.10)

(58) Field of Classification Search
CPC ..... A63B 23/025; A63B 21/4003; A63B 21/4039
See application file for complete search history.

(56) References Cited

U.S. PATENT DOCUMENTS 1,556,496 A 10/1925 Davis
2,051,366 A * 8/1936 Catron ..... A63B 23/025 482/110
2,855,202 A * 10/1958 Kinne ..... A63B 21/4003 482/10
4,168,060 A * 9/1979 Hohenfeldt ..... A63B 21/4003 482/10
5,116,359 A 5/1992 Moore
5,135,445 A 8/1992 Christensen et al.
5,336,138 A 8/1994 Arjawat
5,501,646 A * 3/1996 Miller ..... A63B 23/025 482/10
5,662,554 A 9/1997 Schaefer
6,277,053 B1 8/2001 Desembrana
6,939,269 B2 9/2005 Makofsky
7,104,926 B2 9/2006 Carlson
7,390,286 B1 6/2008 Edgeton
8,038,635 B2 10/2011 Dellanno
8,898,840 B1 12/2014 Majette
9,498,675 B2 11/2016 Walworth
9,873,015 B2 1/2018 Jolly
9,962,575 B2 5/2018 Askins
10,729,935 B2 8/2020 De Falco
11,007,405 B2 5/2021 Hunt et al.
11,040,240 B1 6/2021 Powers
2003/0148863 A1 8/2003 Thomas
2003/0228955 A1* 12/2003 Makofsky ..... A63B 21/169 482/10

(Continued)

FOREIGN PATENT DOCUMENTS

JP 2005113355 A * 4/2005 ..... A42B 1/24

OTHER PUBLICATIONS

JP-2005113355-A (English—Abstract) (Year: 2005).*

*Primary Examiner* — Andrew S Lo

(57) ABSTRACT

Devices and methods are described to aid in neck strengthening. Embodiments of devices described have a lever arm extending outward from the user's chin area, the lever arm having attachment points so that an external load force can be applied such that the user, when counteracting the load force will pull their head backwards at the same time as moving their chin downwards which will, in turn strengthen the neck. The action will strengthen the neck in such a way as to reduce forward head posture and the negative effects of the same.

18 Claims, 9 Drawing Sheets

(56) References Cited

U.S. PATENT DOCUMENTS

| | | | | |
|---|---|---|---|---|
| 2010/0151997 | A1* | 6/2010 | Campbell | A63B 21/065<br>482/11 |
| 2012/0165169 | A1* | 6/2012 | Gatherer | A61H 1/0218<br>482/139 |
| 2013/0053225 | A1 | 2/2013 | Meyer | |
| 2014/0018711 | A1* | 1/2014 | Philipson | A63B 23/03<br>601/38 |
| 2016/0213973 | A1* | 7/2016 | Walworth | A42B 3/0406 |
| 2016/0287935 | A1 | 10/2016 | Sykes | |
| 2020/0060919 | A1 | 2/2020 | Adimari | |

* cited by examiner

NECK STRENGTHENING DEVICE

BACKGROUND

The neck is often overlooked as a body part to target for athletic and strength training, but neglecting the tissues associated with the neck can lead to a myriad of health detriments. On the other hand, strengthening and properly aligning the neck can be a large benefit for athletes and nonathletes alike. One health problem related to weaker neck muscles is referred to as forward head posture. Forward head posture, in turn, can lead to neck pain, back pain, shoulder pain, numbness in the arms, back and more. Prior solutions to address forward head posture relate to neck stretches and chin tucking exercises. However, such neck stretching and chin tucking, on their own, do not provide the type of neck strengthening required to overcome forward head posture.

It is with respect to these and other general considerations that embodiments have been described. Also, although relatively specific problems have been discussed, it should be understood that the embodiments should not be limited to solving the specific problems identified in the background.

SUMMARY

Aspects of the present disclosure relate to devices and methods used to strengthen a user's neck. As will be appreciated, the present disclosure describes embodiments related to a neck strengthening device or head gear having a lever arm extending outward from the user's chin area, the lever arm having attachment points so that an external load force can be applied such that the user, when counteracting the load force will pull their head backwards at the same time as moving their chin downwards which will, in turn strengthen the neck. The action will strengthen the neck in such a way as to reduce forward head posture and the negative effects of the same.

In accordance with these aspects, the present disclosure describes, in part, A neck strengthening device, having a lower portion having a lever arm portion and a chin portion, wherein the lever arm extends outward from the chin portion, a forehead component connected to the lower portion by at least one coupling member. The device may further include an occiput piece and one or more straps used to connect the occiput piece to the lower portion and one or more straps used to connect to the occiput piece to the forehead component. Further, embodiments of the device will have or more connection points associated with the lever arm for attaching a resistance force. Additionally, embodiments include adjustable components to accommodate different sized heads and may include a recess area in the lower portion preventing contact with a neck of a user as well as a depressed region wherein a chin of the user may contact the device. The device be one piece or made of multiple, detachable pieces.

Other aspects relate to methods of strengthening a neck. The methods involve securing a device, as described, to a user and applying an upward force to the lever arm. Next, the user counteracts the external load, by pulling the head backwards while simultaneously rotating the chin downward and back to strengthen the neck.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Embodiments may be practiced as methods, systems or devices. Accordingly, embodiments may take the form of one singular structure on the combination of sub-structures. The following detailed description is therefore not to be taken in a limiting sense, and the scope of the present disclosure is defined by the appended claims and their equivalents.

As previously stated, the neck is often overlooked as a body part to target for athletic and/or strength training which can lead to a common maladapted cervical posture known as forward head posture. Forward head posture is characterized as a change in an individual's musculoskeletal equilibrium in which the head is shifted anteriorly (forward) from its normal anatomical position. The prevalence of this posture in modern society is often attributed to the adoption of technological devices, including cell phones, lap top computers, television and cars, which has resulted in the posture being termed "Tech Neck." During typical use of these technologies, the user assumes a forward head posture for extended periods of time. This results in the lengthening and subsequent weakening of the anterior neck muscles (deep neck flexors) and mid back muscles (e.g., lower trapezius, rhomboids), and the corresponding shortening and overactivation of the pectoral muscles (e.g., pec minor) and upper back muscles (e.g., upper trapezius). Embodiments described herein correct forward head posture strengthening the muscles that have become underactive, while relaxing the muscles that have become overactive.

More specifically, the present disclosure generally pertains to an apparatus and technique for exercising the neck and upper body of users. When used, the device and exercise technique provide a means for strengthening and stretching the neck and upper body to improve posture, reduce pain, increase muscular force generation, coordination and endurance, prevent injury and improve aesthetics. Exercising the neck and upper body is accomplished by the user opposing and overcoming an external load that is applied by the device. Further, the external load is applied at a location and in a direction that forces the user to both pull the head back and downward rotate the head at the same time. The load can be varied such that users may increase the weight/force as their neck strengthens.

Figure 1:
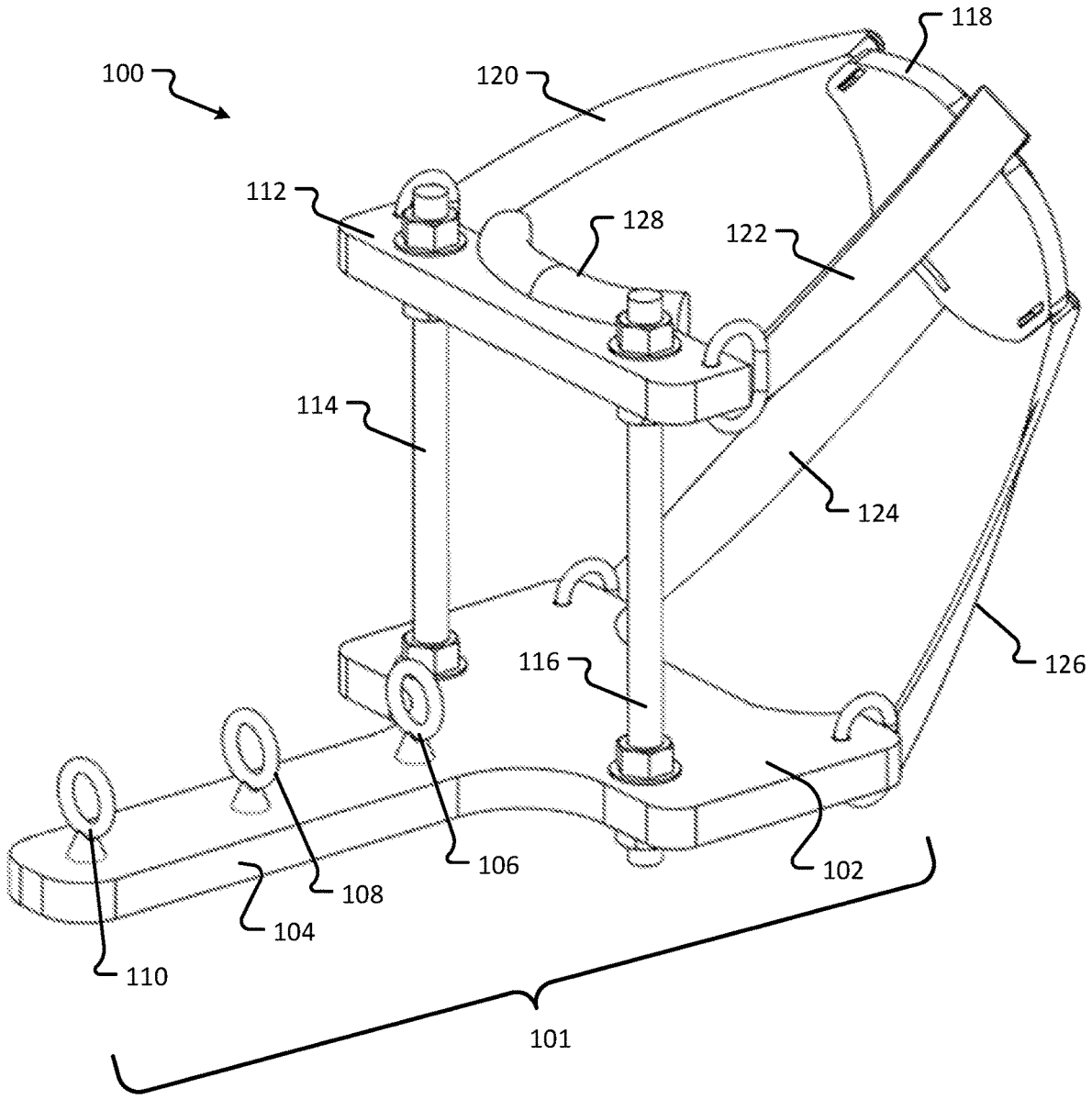
FIG. 1 is a perspective view of a neck strengthening device in accordance with aspects of the present invention.

In accordance with an embodiment of the invention, a neck strengthening device 100 is shown in FIG. 1. The neck strengthening device 100 comprises a number of primary functional components, including: a lower portion 101 which has, in essence both a chin interface portion 102 and a lever arm 104 and one or more load attachment points 106, 108, 110. The device 100 further includes a forehead component 112 that rests against a user's forehead. The lower portion 101 is rigidly affixed to the forehead component 112 by coupling members 114 and 116, which are, in embodiments, adjustable in height to accommodate users with different sized heads. The neck strengthening device 100 further comprises an occiput pad 118, which secures the device 100 to the user's head from behind. The occiput pad 118 is attached to both the chin component 102 and the forehead component by adjustable straps 120, 122, 124 and 126 to accommodate different head sizes and for improved comfort. The forehead component 112 may further have a forehead padding 128 for improved comfort.

When the neck strengthening device 100 is worn by a user and an upward, external load is applied to one of the attachment points 106, 108, 110, as discussed below, an upward force is applied to the user's chin that must be overcome by the user pushing down onto the chin component. As the user pushes down on the chin component 102 to resist the external load, there is a tendency for the device to rotate backwards, which necessitates the forehead component 112 to resist this rotation. Thus, when an external load is applied to the device 100, the forehead component 112 will push backwards onto the user's forehead, requiring a forward force be applied by the user at the forehead. The combination of this downward force at the chin and forward force at the forehead creates a forward torque by the user. Pulling backwards against the occiput pad 118 creates the translational or retraction force applied by the user which, in turn, strengthens the user's neck muscles to help correct forward head posture.

Figure 2:
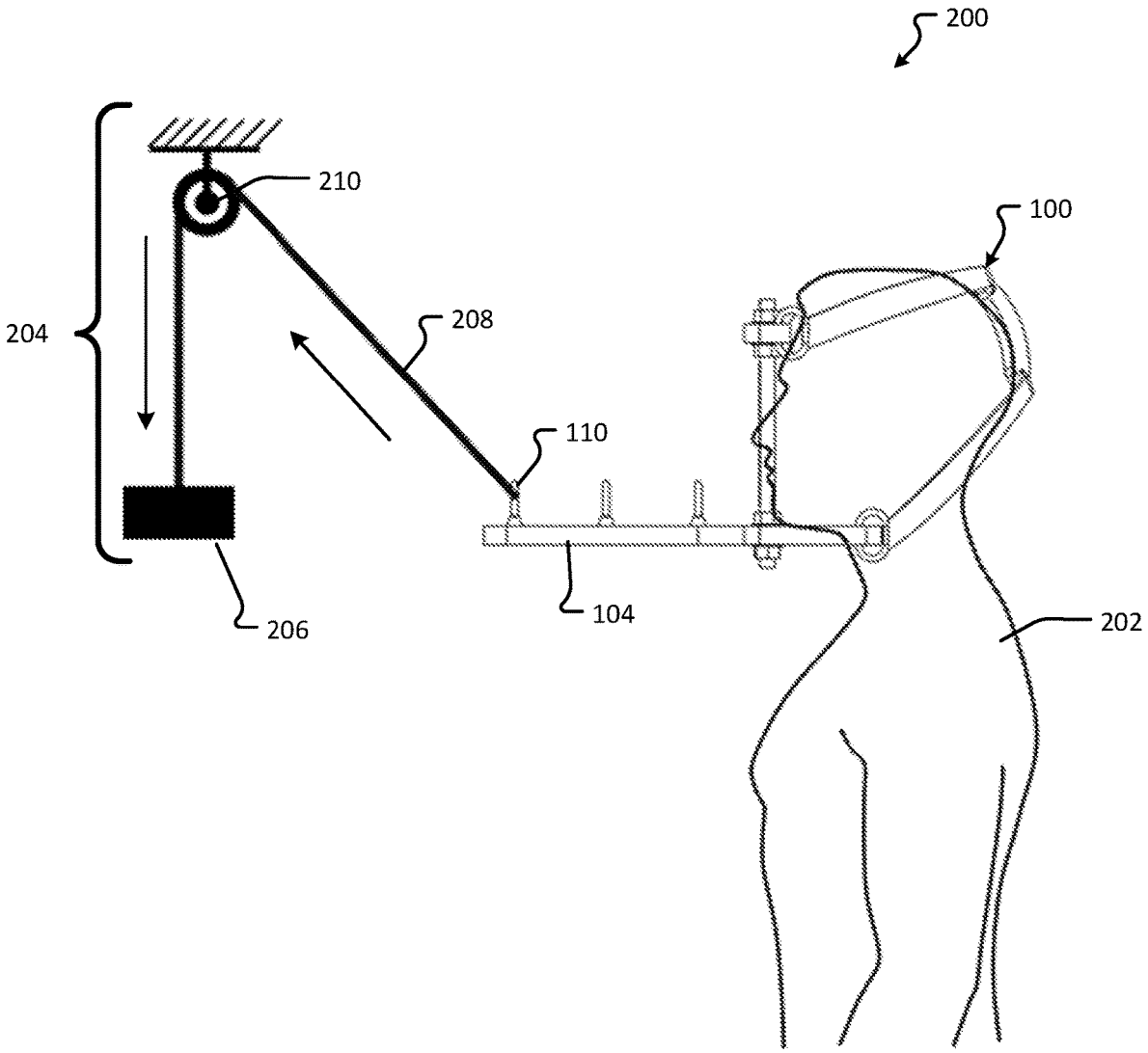
FIG. 2 is side view of the neck strengthening device as shown in FIG. 1 further showing the neck strengthening device as worn by a user and illustrating an exemplary load force being applied to the neck strengthening device.

FIG. 2 illustrates an exemplary environment 200 where the neck strengthening device 100 of FIG. 1, is worn by user 202, and connected to a load apparatus 204 for applying force to the lever arm 104 of the device 100. Also shown in FIG. 2 is an exemplary load 206 as part of apparatus 204 being applied to the neck strengthening device 100 as anticipated during use of the neck strengthening device 100. In the example environment 200 of FIG. 2, the load 206 may be a weight connected to an attachment point 110 of the neck strengthening device 100 via cable 208 through a pulley 210. As may be appreciated by those skilled in the load apparatus 204 may involve many different types of elements used to apply the upward, angular force to the lever arm 104, such as springs or resistance bands, a weight and pulley system (shown), pneumatic resistance, deformable material, combinations of these methods, or any other means of applying an external load.

Figure 3B:
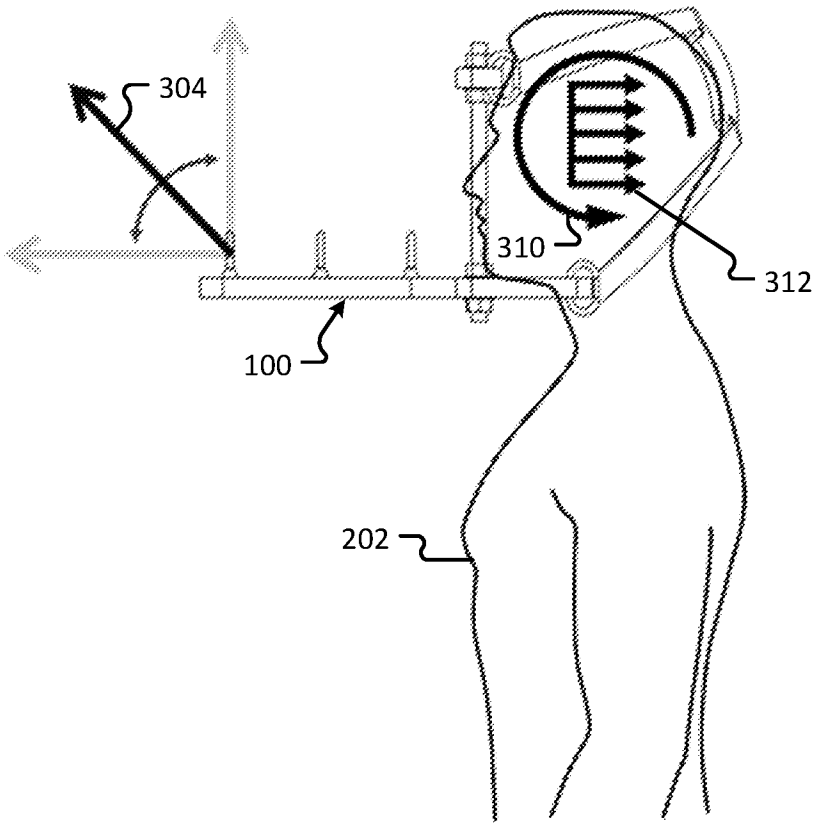
FIG. 3B is a side view of the user in FIG. 3A, also wearing the neck strengthening device of FIGS. 1 and 2, further illustrating a second position of the user's head in a straightened posture, e.g., the ending position for exercising their neck in accordance with aspects of the present invention.
Figure 3A:
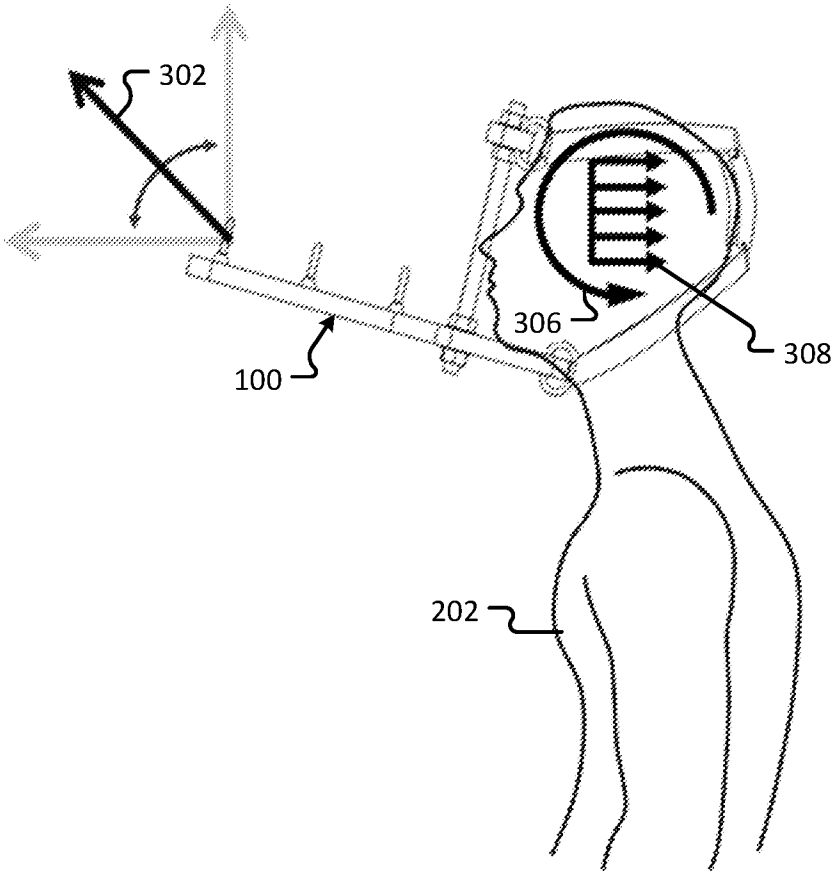
FIG. 3A is a side view of the user in FIG. 2 wearing the neck strengthening device of FIGS. 1 and 2, further illustrating a first position of the user's head in a forward head position, e.g., the starting position for exercising their neck in accordance with aspects of the present invention.

FIGS. 3A and 3B represent side views of the user 202 in FIG. 2 wearing the neck strengthening device 100 of FIG. 1, further illustrating a first position of the user's head in a forward head posture, e.g., the starting position for exercising their neck in accordance with aspects of the present invention and a second position of the user's head in a straightened posture, e.g., the ending position for exercising their neck in accordance with aspects of the present invention. As will be appreciated, the user 202 may then move their head from the second position back to the first position to repeat the movement from the first position back to the second position. The repetition of this motion, working against an applied force will help strengthen the user's neck muscles.

Also shown in FIGS. 3A and 3B are force arrows 302 and 304 which are shown to indicate different forces applied to the device 100, e.g., by an external load apparatus. Depending on the load apparatus, e.g., load apparatus 204 of FIG. 2, the actual angle of forces represented by force arrows 302 and 304 may change from the first position to the second position, but such change in the specific angle is not necessarily significant in use of the current device as the primary force remains relatively constant and controlled. Further, as discussed below, the force arrows 302 and 304 indicate angular forces applied to the device 100 in such a way as to apply an external load having both a translational (linear force) component and a rotational (torque) component. This is accomplished by applying an external load to one of multiple attachment points, e.g., points 106, 108, 110 on the lever arm 104 of the device 100 The translational and rotational forces are variable and may be adjusted for different users to allow for maximus strength building without risking injury. Indeed, different loads could be applied at different angles (i.e., the resistance could be placed at different heights) to accentuate different aspects of the exercise. An angle more in front of the user will accentuate the pulling back motion (retraction) by making it more difficult, and an angle more above the user will accentuate the head rotation (nodding) aspect of the exercise.

Also shown in FIGS. 3A and 3B are force arrows 306, 308, 310 and 312 further indicating the type and direction of force applied by user 202 while in, and while moving from the first position shown in FIG. 3A to the second position shown in FIG. 3B. More specifically, force arrows 306 and 310 indicate that the user 202 applies or uses a rotational movement, in counter-clockwise direction as indicated from the perspective of FIGS. 3A and 3B. In other words, the user 202 must move their forehead forward and chin backward to work against the force 302 or 304. Moreover, in embodiments, the user may also move their head in a backward direction as indicated by force arrows 308 and 312. In preferred embodiments, the user 202 may apply both a rotational movement 306, 310 and a backward movement 308 and 312 at the same time to provide a better exercise motion. That is, to counteract and overcome the external load, the user must pull the head backwards while simultaneously pushing down at the chin. This combination requires the user to apply both a backward translational force as well as a forward torque. FIG. 3A shows the relaxed, or protracted phase of a possible exercise repetition and FIG. 3B shows the engaged, or retracted phase of the exercise repetition.

Figure 4:
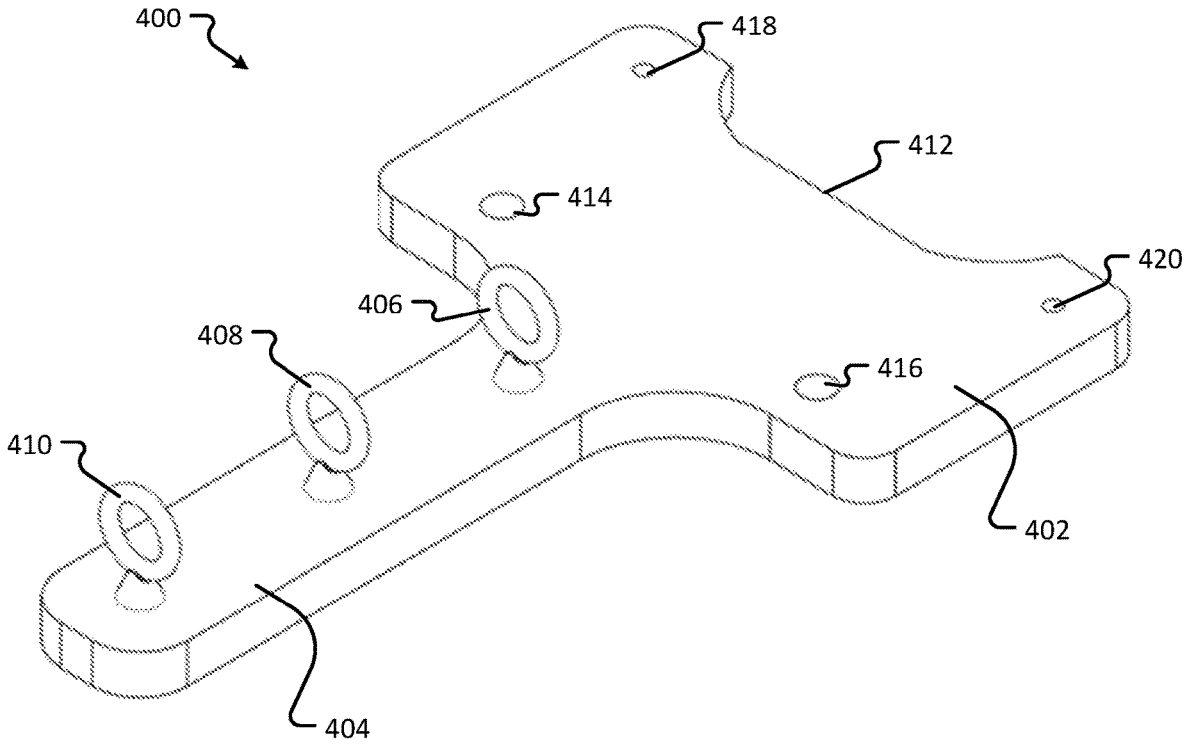
FIG. 4 illustrates a perspective view of chin portion and a lever arm, the lever arm having attachment points of the neck strengthening device of FIG. 1 in accordance with aspects of the present invention.

FIG. 4 illustrates a perspective view of a lower portion 400 of the device 100 (FIG. 1) having a chin portion 402 and a lever arm 404 extending outward from rear chin portion 402. The lever arm 404 further having attachment points 406, 408 and 410 in accordance with aspects of the present invention. In an embodiment, the chin portion 402 has a recess area 412 that is concavely curved inward for the chin to rest against. In other embodiments, the chin rests on top of the recess area such that a downward force from the chin can be applied to the chin portion 402 using the chin itself. In such an embodiment the recess area 412 is designed to prevent contact with the user's neck when the user has applied the downward force to the chin portion 402. Other embodiments may further include padding in or around the recess area 412 for comfort. Those skilled in the art will appreciate that the chin interface portion 400 should be rigid and strong enough to withstand the load forces being applied. That said, the chin interface portion 400 may be made of metal, plastic, wood and/or other material that would provide the necessary strength and rigidity.

As stated, the lever arm 404 provides multiple connection points 406, 408 and 410 to attach an external load that are distributed at different lengths from the user's chin and from the recess area 412. The shown embodiment illustrates these attachment points 406, 408 and 410 as eye hooks affixed to the lever arm 404 in a line extending outward. Those skilled in the art will appreciate that other connection points of different forms and at different locations could also be included to induce different loading patterns and exercise options for the user. Applying an external load to at least one of the various connection points 406, 408 or 410, as shown in FIGS. 2, 3A and 3B, will apply different amounts of torque with the same amount of load, with the torque increasing as the load is applied further way from the user's chin, e.g., the torque applied when the load is attached to connection point 410 is greater than the torque applied when the load is attached to connection point 406, as is known in the art. In essence, the torque applied at the user's chin follows the relationship of FORCE×DISTANCE, where the FORCE is the component of the applied load that is perpendicular to the lever arm and DISTANCE is the length away from the user's chin. Therefore, the presence of multiple attachment points allows the user to change the rotational or torque component of the exercise load.

In the present embodiment, the lower portion 400 is shown as a flat platform, but the lower portion 400 may be rounded or may include additional indentations and/or padding to improve comfort for the user, as described in more detail below. Moreover, while not shown, this portion may also include supports or pads that would interface with the side of the user's jaw or chin for configurations in which load could be applied from various directions, to allow the user to resist these various loads and prevent slipping or relative movement of the device. These supports could be fixed in a one-size-fits-all configuration, or adjustable to accommodate different chin/jaw shapes and sizes.

In the embodiment shown, the lower portion 400 further include holes 414 and 416 that are used in conjunction with the coupling members, e.g., coupling members 114 and 116 described above in conjunction with FIG. 1, to attach the forehead member, e.g., forehead member 112 described in conjunction with FIG. 1. Those skilled in the art will recognize that there may be other aspects to the lower portion 400 that can be added without deviating from the scope of the present innovation.

FIG. 4 further shows hole 418 and hole 420 which are connection points for adjustable straps 124 and 126, as shown in FIG. 1. Those skilled in the art will appreciate that other connections could be used, e.g., instead of holes to receive straps or strap rings, the connection points may be fixed eye hooks, among many other potential connectors or connection points. For example, in another embodiment, the connection points may simply be a hole in the lever arm designed to receive a connector device, such as a carabiner that can be used to attach a load.

Figure 5:
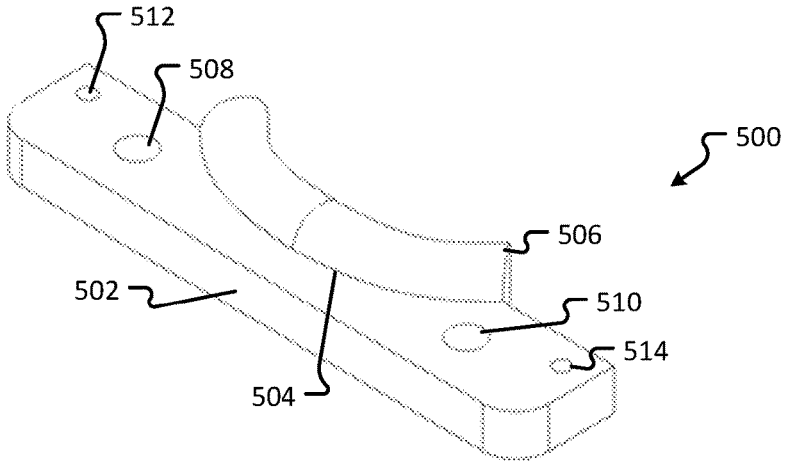
FIG. 5 illustrates a perspective view of an exemplary forehead component of the neck strengthening device of FIG. 1 in accordance with aspects of the present invention.

FIG. 5 illustrates a perspective view of an exemplary forehead component 500 of the neck strengthening device 100 shown and described in conjunction with FIG. 1 above. The forehead component 500 is rigidly fixated to the lower portion 400 and comprises the second point necessary to create the force/moment couple that creates the rotational aspect of the load applied to the user described previously.

In accordance with aspects of the present invention, the forehead component 500 is formed with a rigid body 502, the ridged body 502 having a concave indent portion 504 for providing contact with the user's forehead. The concave indent portion may be padded for comfort, such as by the pad 506, shown in FIG. 5. Those skilled in the art will appreciate that the forehead component 500 is rigid and strong enough to withstand the load forces being applied. That said, the forehead component 500 may be made of metal, plastic, wood and/or other material that would provide the necessary strength and rigidity.

In the embodiment shown in FIG. 5, the forehead component 500 further includes holes 508 and 510 that are used in conjunction with the coupling members, e.g., coupling members 114 and 116 described above in conjunction with FIG. 1, to attach the forehead member 500 to the chin portion, e.g., chin portion 400, described above in conjunction with FIG. 4. Those skilled in the art will recognize that there may be other aspects to the forehead component 500 that can be added without deviated from the scope of the present innovation.

FIG. 5 further shows hole 512 and hole 514 which are connection points for adjustable straps 120 and 122, as shown in FIG. 1. Those skilled in the art will appreciate that other connections could be used, e.g., instead of holes to receive straps or strap rings, the connection points may be fixed eye hooks, among many other potential connectors.

Figure 6:
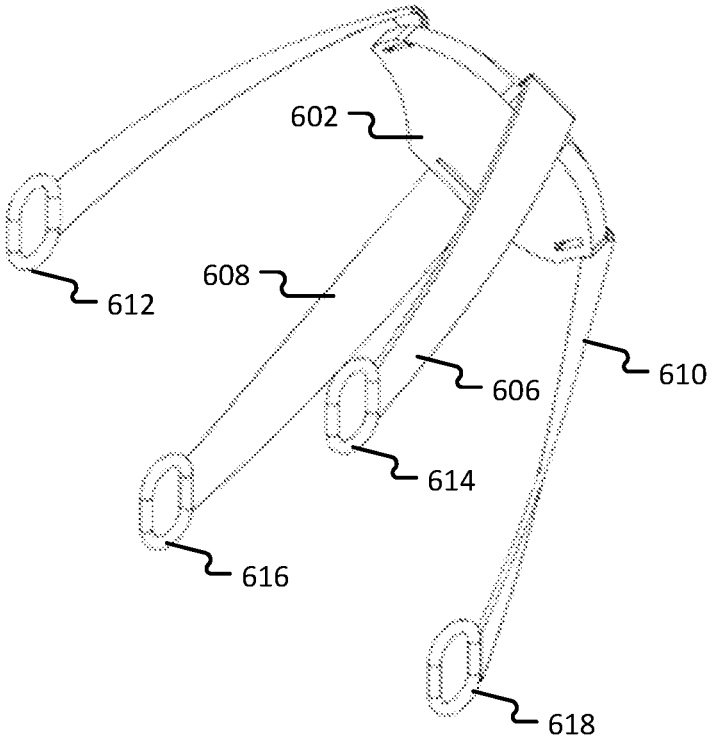
FIG. 6 illustrates a perspective view of an exemplary occiput portion and straps of the neck strengthening device of FIG. 1 in accordance with aspects of the present invention.

FIG. 6 shows an occiput pad 602 and connection straps 604, 606, 608 and 610, which are used as part of an embodiment of a neck strengthening device, e.g., neck strengthening device 100 described above in conjunction with FIG. 1. The occiput pad 602 is of size and shape to comfortably interface with the back of user's head. The occiput pad 602 interfaces with the back of the user's head to provide support relative to both the chin component and the forehead component. The occiput pad is semi rigid yet padded or made of a soft enough material to be comfortable to the user. When in use, the occiput pad should interface with the back of the user's skull, high enough as to not interfere with articulation of the base of the skull and the upper cervical spine. Those skilled in the art will appreciate that different types of pads and materials could be used to secure the user's head from behind.

As shown, the occiput pad 602 is connected to connection straps 604, 606, 608 and 610. In an embodiment, the connection straps 604, 606, 608 and 610 are adjustable to help secure the device 100 to the user's head without being too tight. The connection straps 604, and 606 attach to the forehead component 500, while straps 608 and 610 attach to the chin portion 400. The connection straps 604, 606, 608 and 610 may connect in various ways, e.g., using the holes 512, 514, 418 and 420 respectively. As shown, the connection straps 604, 606, 608 and 610 may use oval screw links 612, 614 616 and 618, respectively. Length adjustment of the straps can be accomplished by a number of means, including a ring and Velcro system, adjustable buckles, ratchet systems or any other means of adjusting the length of a strap. Straps are used in the present embodiment, but other means of securing the device to the user's head could be implemented in different embodiments, including ropes, cloth, tension member (elastic bands), or other means of securing the device to the user's head. Those skilled in the art may appreciate that there are other, acceptable means and methods of securing the device to the user's head.

Figure 7:
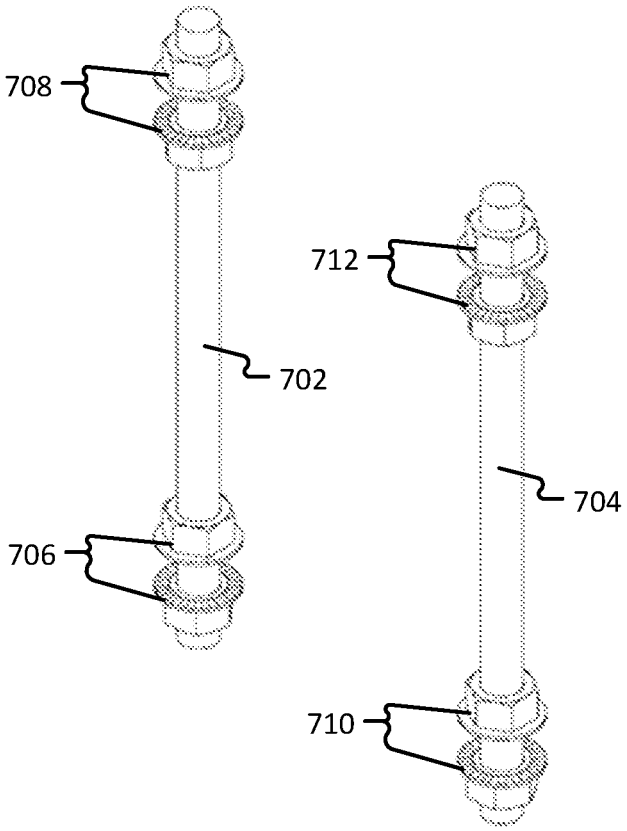
FIG. 7 illustrate perspective views of exemplary coupling members of the neck strengthening device of FIG. 1 in accordance with aspects of the present invention.

FIG. 7 shows exemplary coupling members 702 and 704 which rigidly connect the lower portion 400 to the forehead component 500. In the embodiment shown in FIG. 7, the coupling members 702 and 704 consist of threaded rods with flanged hex nuts 706, 708, 710 and 712 to secure the coupling members to both the lower portion 400 and forehead component 500, e.g., using holes 418, 512, 420 and 514, respectively. This configuration also allows for adjustment of the distance between the chin and forehead components by simply spinning the nuts surrounding either the lower portion 400 or forehead component 500 to adjust their height on the coupling members. In other embodiments of the device, the coupling rods could be integrated as a single piece to either the chin component, the forehead component or both as would be the case if the entire device was 3D-printed or injection molded, as described below. The coupling members 702 and 704 primarily connect the lower portion 400 to forehead component 500 in a manner that provides ridged stability to withstand the forces applied during exercise under a load. As those skilled in the art will appreciate, other means, e.g., besides threaded rods with flanged hex nuts, may be used to connect the forehead component 500 to the lower portion 400.

Figure 8:
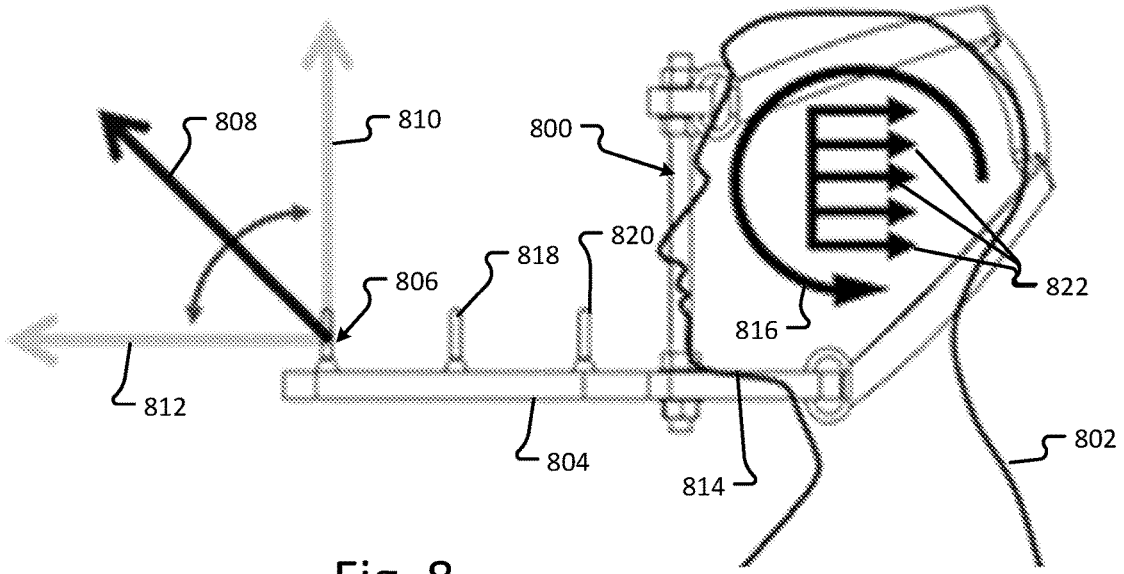
FIG. 8 illustrates the side view figure of the user in FIG. 3B, wearing the neck strengthening device and in the second position, but further shown enlarged to better illustrate the force angles that may be applied to the neck strengthening device in accordance with aspects of the present invention.

FIG. 8 illustrates the side view figure of the user in FIG. 3B, wearing the neck strengthening device and in the second position, but further shown enlarged to better illustrate the force angles that may be applied to the neck strengthening device in accordance with aspects of the present invention. While FIG. 3B was shown and described in conjunction with FIG. 3A to illustrate two different positions of an exercise under load, FIG. 8 is shown and described in conjunction with FIG. 9, which is a force diagram illustrating various forces that may be applied and counteracted in accordance with aspects of the present invention. Given the difference in purpose for the discussion of FIG. 8, new numbering for similar items is used.

FIG. 8 illustrates user 802 wearing a neck strengthening device 800, wherein a load may be applied to the lever arm 804 of device 800. In the example shown in FIG. 8, the force may be applied at connection point 806 and in an angled direction, as indicated by arrow 808. As is known in the art, the angled force (or load) may be broken down into a vertical force, as indicated by force arrow 810 and a lateral or translational force, as indicated by force arrow 812.

In response to the force 808, the user reaction demands a resistive load be applied by the user 802 at the chin 814, thus facilitating forward rotational torque (depicted by resistance force arrow 816) of the head and opposing the backward head rotation component of forward head posture. As this applied load 808 is moved further away from the chin along the lever arm 804, e.g., at connection point 806 instead of connection point 818, the downward force requirement at the chin increases linearly. Consequently, some embodiments of device 800 provide multiple attachment points 806, 818 and 820 along the lever arm 804 to allow the user 802 to vary the difficulty of the rotational component of the exercise without changing the applied load 808 (e.g., increasing weight or resistance band tension). The horizontal load or force component 812 (or the horizontal component of an angled load) must be overcome by the user 802 pulling the head backwards (as indicated by force arrows 822), thus opposing the cervical protraction portion of forward head posture. This translational component 822 of the exercise can be made more challenging by making the applied load more horizontal and less vertical (e.g., cable or resistance band in front of the user as opposed to above). An angled external load, 45 degrees in front of and above the user for example, will require both forward rotational torque of the head and backwards pulling of the head by the user, thus opposing both of the maladaptive posture components of forward head posture.

Figure 9:
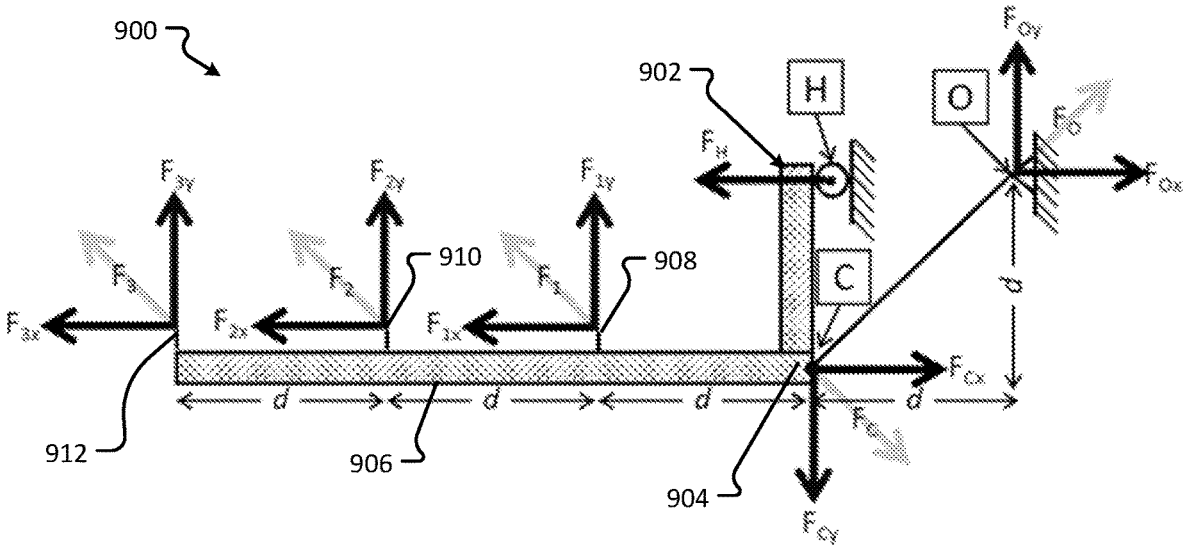
FIG. 9 is a force diagram illustrating various forces that may be applied and counteracted in accordance with aspects of the present invention.

FIG. 9 illustrates a simplified mathematical model 900 of the device shown on the right. C denotes the chin, H denotes the head (specifically the forehead), and O denotes the occiput, or back of the skull. The device 900, which represents devices 800 in FIGS. 8 and 100 in FIG. 1, is modeled as a horizontal beam 902 having the chin component 904 and lever arm 906, and a vertical beam denoting the connecting rods and forehead component. The chin, C, can provide downward and backwards forces to oppose a given applied external load. The forehead, H, is modeled as a roller, and can only provide a forward x-axis force to oppose a given external load. The back of the skull, O, is modeled as a pin with a tension element (e.g., rope or strap) that can provide upwards and backwards forces to oppose a given external load. An arbitrary length, d, is used to illustrate distance relationships for the purpose of explaining differences in forces. Other embodiments may not follow these distance relationships, as they are only used here to depict the relationship between applied external load and the resistive loads the user of the device must apply when performing an exercise. This simplified model assumes a static force equilibrium, which would be the case for holding an isometric contraction when exercising with the device. $F_1$, $F_2$ and $F_3$ depict possible externally applied loads at 3 different attachment points on the lever arm. These forces, as well as the reaction forces at C and O, are broken down into their y (vertical) and x (horizontal) components. In practice, the external load could be applied at any angle between vertical and horizontal and would have both vertical and horizontal force components.

As stated, the simplified model as depicted in FIG. 9 assumes static equilibrium, which means all forces and moments acting on the object have equal and opposing net forces and moments and the object is not moving. Functionally, this is equivalent to a user of the device holding an isometric contraction, with the musculature of the individual opposing the applied external load. The exercise described below illustrates the relationships between loads applied at points 908, 910 and 912 acting in either the y (vertical) or x (horizontal) direction. To calculate these relationships, forces in the y and x directions, and moments about multiple points on the object will be summed and equated to zero, in order to satisfy the static equilibrium assumption.

For an external load applied in they (vertical) direction only the sum of moments about points O and C (moment=force×distance) and sum of y and x direction forces are shown below.

Force applied at point 908 in FIG. 9:

$$\Sigma M_O: F_{1y}\cdot(2d)-F_{Cy}\cdot(d)=0\rightarrow F_{Cy}=2F_{1y}$$

$$\Sigma M_C: F_{1y}\cdot(d)-F_{Hx}\cdot(d)=0\rightarrow F_{Hx}=F_{1y}$$

$$\Sigma F_y: F_{1y}-F_{Cy}+F_{Oy}=0\rightarrow F_{1y}-2F_{1y}=-F_{Oy}\rightarrow F_{Oy}=F_{1y}$$

$$\Sigma F_x: F_{Hx}-F_{Cx}-F_{Ox}=0\rightarrow F_{Hx}=F_{Cx}+F_{Ox}\rightarrow F_{Cx}+F_{Ox}=F_{1y}$$

Force applied at point 910 in FIG. 9:

$$\Sigma M_O: F_{2y}\cdot(3d)-C_y\cdot(d)=0\rightarrow F_{Cy}=3F_{2y}$$

$$\Sigma M_C: F_{2y}\cdot(2d)-F_{Hx}\cdot(d)=0\rightarrow F_{Hx}=2F_{2y}$$

$$\Sigma F_y: F_{2y}-F_{Cy}+F_{Oy}=0\rightarrow F_{2y}-3F_{2y}=-F_{Oy}\rightarrow F_{Oy}=2F_{2y}$$

$$\Sigma F_x: F_{Hx}-F_{Cx}-F_{Ox}=0\rightarrow F_{Hx}=F_{Cx}+F_{Ox}\rightarrow F_{Cx}+F_{Ox}=2F_{2y}$$

Force applied at point 912 in FIG. 9:

$$\Sigma M_O: F_{2y}\cdot(4d)-C_y\cdot(d)=0\rightarrow F_{Cy}=4F_{3y}$$

$$\Sigma M_C: F_{3y}\cdot(3d)-F_{Hx}\cdot(d)=0\rightarrow F_{Hx}=3F_{3y}$$

$$\Sigma F_y: F_{3y}-F_{Cy}+F_{Oy}=0\rightarrow F_{3y}\rightarrow F_{3y}=-F_{Oy}\rightarrow F_{Oy}=3F_{3y}$$

$$\Sigma F_x: F_{Hx}-F_{Cx}-F_{Ox}=0\rightarrow F_{Hx}=F_{Cx}+F_{Ox}\rightarrow F_{Cx}+F_{Ox}=3F_{3y}$$

The above force formulas each involve an external load that is applied at increasing distances from the chin (point O) (FIG. 9), and as the distance increases, a larger moment (a.k.a. torque) is applied on the device. This requires larger loads be applied by the user of the device in order to maintain static equilibrium, or to hold an isometric contraction. This load amplification is the largest at the chin (point O), followed by the forehead (point H) and occiput (point O), for the distance relationships used in this simplified model.

For an external load applied in the x (horizontal) direction only, the sum of moments about points O and C (moment=force×distance) and sum of y and x direction forces are shown below. Horizontal applied loads in the x direction all act in the same line of force at points 908, 910, and 912. So, a horizontal load is effectively the same at any of the load application points.

Force applied at point 908 or 910 or 912:

$$\Sigma M_O: F_{1x}\cdot(d)-F_{Cx}\cdot(d)=0\rightarrow F_{Cx}=F_{1x}$$

$$\Sigma M_C: F_{Hx}\cdot(d)-F_{Ox}\cdot(d)=0\rightarrow F_{Hx}=F_{Ox}\text{(0 for simplified model)}$$

$$\Sigma F_x: F_{1x}+F_{Hx}-F_{Cx}-F_{Ox}=0\rightarrow -F_{Hx}F_{Cx}F_{Ox}=F_{1x}\text{(assuming } F_{Cx} \text{ can take the load)}\rightarrow F_{Cx}=F_{1x}$$

$$\Sigma F_y: F_{Cy}+F_{Oy}=0\rightarrow F_{Cy}=-F_{Oy}\text{(0 for simplified model)}$$

As shown, a horizontal load applied at any of the load attachment points 908, 910, or 912 could theoretically be counteracted by an equal and opposite horizontal load at the chin (point C). As will be appreciated, the chin portion cannot take much external load without slipping, so the occiput component (point O) would have to take some of the horizontal load (this is the purpose of having the occiput component). This would also induce a small moment in the device. Consequently, the chin, at point C and occiput at point O would combine to counteract a horizontal load.

Figure 10A:
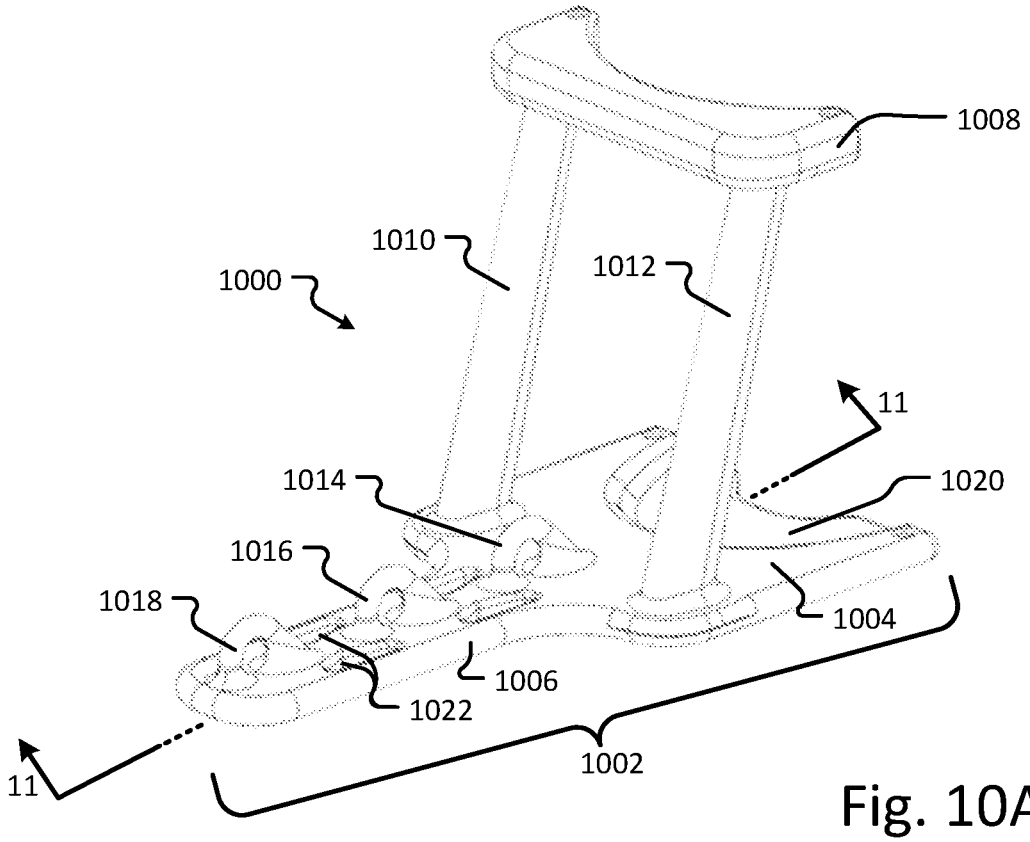
FIGS. 10A and 10B illustrate another exemplary embodiment of a neck strengthening device in accordance with aspects of the presentation.
Figure 10B:
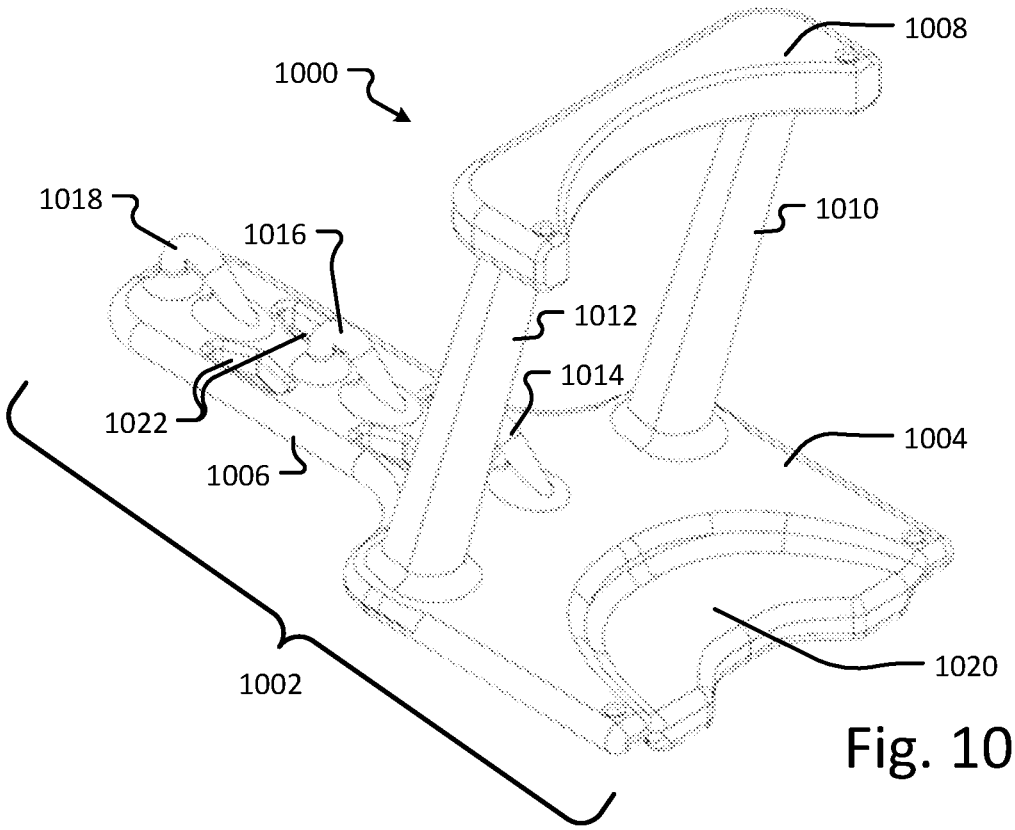

FIGS. 10A and 10B depict two plan views of another embodiment of a neck strengthening device 1000 utilizing innovations described herein. As shown in these FIGS. 10A and 10B, the neck strengthening device 1000 has a lower portion that includes both a chin portion 1004 and lever arm 1006. The device 1000 further has a forehead portion 1008 connected to the lower portion by braces 1010 and 1012. The lever arm 1006 has connection points 1014, 1016 and 1018, each a predefined, but different distance from the chin portion 1004. Additionally, the device 1000 further has a depressed area 1020, which provides a predefined area where the chin can rest, which is described in more detail below. The lever arm 1004 may further comprise one or more holes, such has holes 1022 for further attaching a sideways, translational load force to further enable enhanced exercising of the neck in different directions.

The configuration shown in FIGS. 10A and 10B enables device 1000, including all the portions shown, to be fabricated as a single component. A variety of manufacturing techniques could be utilized to produce such embodiments, including but not limited to casting, molding, injection molding, 3D printing, milling/machining, or sintering.

In the embodiment of the device 1000 shown in FIGS. 10A and 10B, the load attachment points 1014, 1016 and 1018 are semicircular rings that integrate directly into the lever arm 1006 of the device 1000. These loops or rings are angulated with additional material at the back (towards the user) and base of the ring to provide additional strength to support external load. The embodiment shown also includes coupling members or braces 1010 and 1012 that are thickest at their base at the lower portion 1002 and decrease in cross-sectional area as they extend upwards to the forehead portion 1008. The braces are also angled backwards from the lower portion 1002, towards the forehead portion 1008, as shown. Both the thicker base and the angled orientation of the coupling members provide additional strength to the braces 1010 and 1012 over a simple vertical rod.

Figure 11:
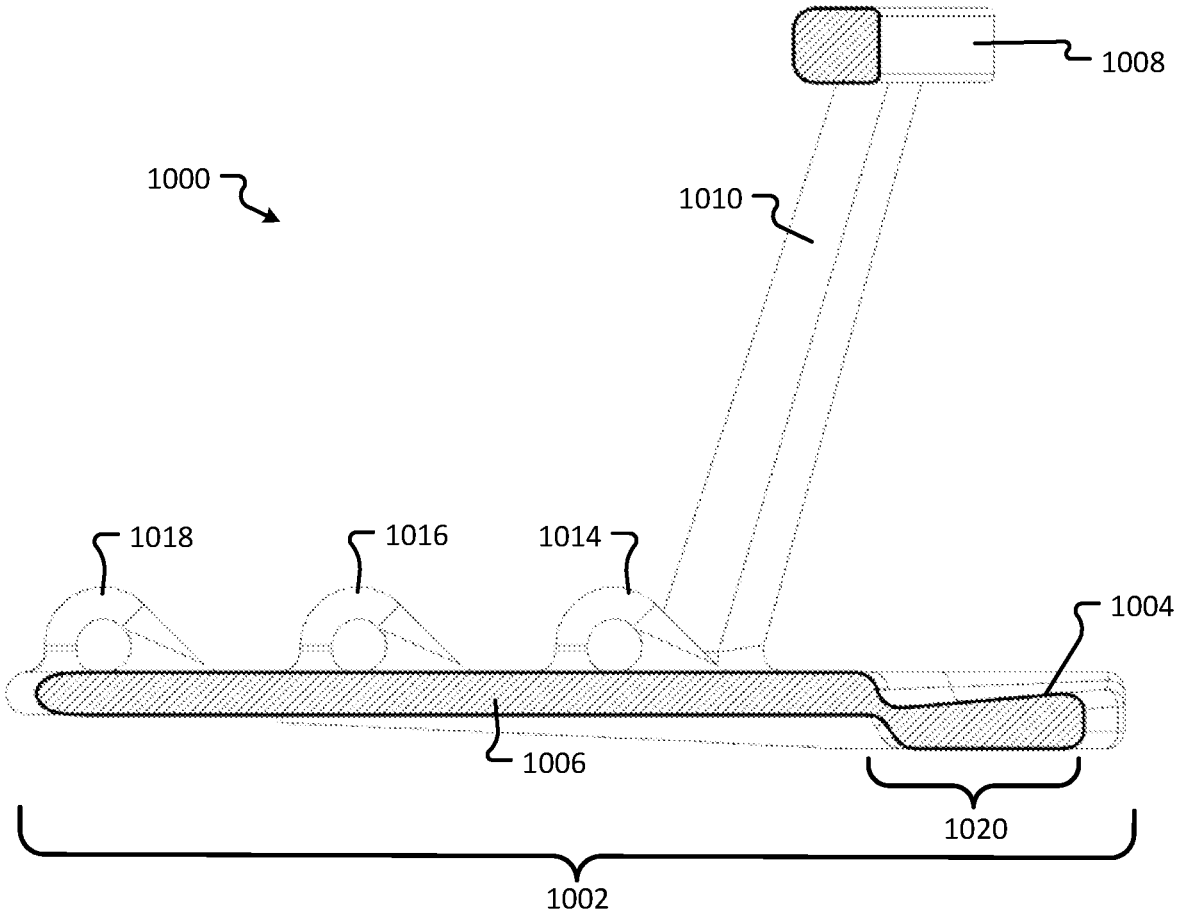
FIG. 11 is cross-sectional planar view of the neck strengthening device, as shown in FIGS. 10A and 10B, illustrating an angular aspect to a chin resting portion of the neck strengthening device in accordance with aspects of the present invention.

FIG. 11 is a cross-sectional view of the device shown in FIGS. 10A and 10B, as taken along cross section lines shown in FIG. 10A. As shown in FIG. 11, the device 1000 shows the lower portion 1002, the chin portion 1004 and the lever arm 1006 with connection points 1014, 1016 and 1018. FIG. 11 further shows the brace 1010 connecting the lower portion 1002 to the forehead portion 1008.

In the cross sectional view of the embodiment shown in FIG. 11, the depressed area 1020 can be seen more clearly. The depressed area 1020 is designed so that a user's chin can rest within the depressed area therefore reduce slippage and/or provide added comfort and support. As shown, in embodiments, the base of the depressed area 1020 has a downward taper angle to mimic a natural angle of a user's jawline. The back of the depression is rounded to eliminate potential irritation of the user's chin/jaw and includes a cut-away, or recess, allowing the user to retract the head without the device pressing into the throat or neck.

Figure 12:
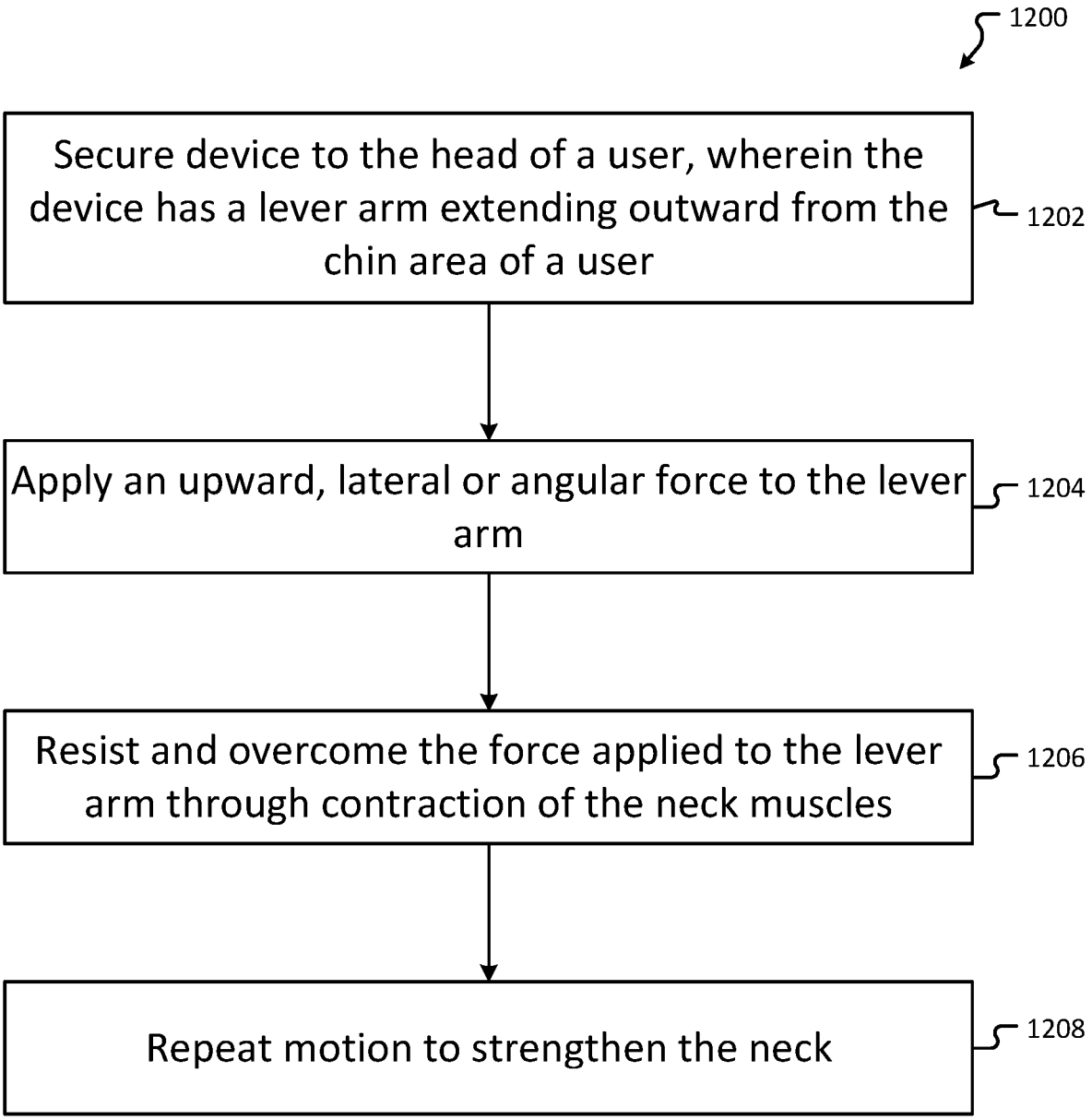
FIG. 12 is an overview of an example method according to at least some aspects of the technique taught herein.

FIG. 12 is an overview of an example method 1200 relating to strengthening a user's neck in accordance with techniques and devices described herein. Initially, flow 1200 begins with securing a device to a user's head that is used during the exercise. The device is one that has a lever arm extending outwardly from the user's chin area. In embodiments, the device is the device 100 shown in FIG. 1, and in other embodiments, the device may be as shown in FIGS. 10A and 10B. The lever arm may extend at different angles outwardly from the chin area, but it should extend enough to allow for application of an upward force to the lever arm.

Next, once the device is secured to the user's head, a force is applied 1204 to the lever arm in an upward direction, a lateral direction and/or a combination of both, e.g., an angular direction. When the force is applied angularly, it may be applied in an angular direction away from the user. The application of the force to the lever arm should be such that the user can resist and overcome the force by tucking their chin down and back towards their neck. In embodiments, the user is now in the first position, such as shown in FIG. 3A.

Following application of the force, the user begins the exercise method. The user, at step 1206, will resist and overcome the external load applied by the device described herein by activating and contracting muscles of the front of the user's neck and mid back. This muscle activation pattern is, in embodiments, coupled with the relaxation and lengthening of the muscles of the chest and at the base of the skull. This combination of muscle activation and relaxation pulls the user into correct cervical and thoracic spinal posture, while simultaneously applying spinal traction. In embodiments, the user is now in the second position, as shown and described above in conjunction with FIG. 3B.

Following resist and overcome step 1206, repeat operation 1208 provides for the user to move from the contracted position, i.e., the second position back to the starting position, i.e., the first position. By repeating the activation and contracting of the muscles of the front of the user's neck and mid back, the user's neck with strengthen over time.

In using the device and technique described herein, a user may correct forward head posture. This is accomplished by strengthening weakened muscles associated with forward head posture while simultaneously stretching the opposing, overactivated muscles. The muscles targeted for strengthening include the muscles in the front of the neck, known as the deep cervical flexors, including longus capitus and longus colli, and muscles of the mid back, including the mid and lower trapezius and rhomboids. The muscles targeted for stretching include those that connect the back of the skull to the upper neck, known as the suboccipital muscles, and the muscles of the chest, especially pectoralis minor.

As will be appreciated by those skilled in the art, the device described herein allows for multiple exercise variations that would activate different muscle groups isometrically (static), concentrically (muscle shortening) and/or eccentrically (muscle lengthening). These exercise variations depend on the angle at which load is applied as well as the posture and movements the user assumes. One exercise technique would be simple protraction-retraction movement of the head (forward and backward translation) with a load applied at 0 degrees, or straight in front of the user. Another technique would be neck flexion-extension (nodding the head up and down) with the load applied at 90 degrees, or straight up. A combination of these techniques could be accomplished by both retracting the head (pulling back) while simultaneously flexing the neck (nodding head downward) with a load applied at 45 degrees in front of the user's head. Isometric exercise could also be accomplished by applying a load anywhere from 0-90 degrees and holding the head in proper alignment to statically resist the applied load. Additional shoulder, core or lower body exercises could be performed by the user while simultaneously holding this isometric contraction to integrate proper cervical alignment into more global movement patterns.

While some benefits have been discussed above, it is believed there are others. For instance, strengthening the neck according to aspects describe herein may help reduce the effect of concussions, or mild traumatic brain injuries (MTBI), on users. Concussive injuries are common in sports in which the athlete's head and neck is subject to rapid accelerations or decelerations, such as American football, rugby, soccer, lacrosse, boxing and other combat sports. Blows that cause rapid rotation of the head put individuals at an even higher risk of sustaining concussive injuries. Aside from athletics, concussions are also common occupationally and frequently occur during automobile accidents and falls. Strengthening and conditioning of the neck can reduce the risk of sustaining concussive injuries.

In addition to reducing the occurrence of concussion, strengthening and conditioning of the neck reduces injury risk to the neck itself, which includes muscles, tendons, ligaments, vertebra, intervertebral disks and nerves. Sagging or loosening tissues of the front of the neck is considered an aesthetically unappealing physiological change that is associated with age and weight gain. This sagging of the front of the neck may likewise be reduced through exercise as described herein.

The description and illustrations of one or more aspects provided in this application are not intended to limit or restrict the scope of the disclosure as claimed in any way. The aspects, examples, and details provided in this application are considered sufficient to convey possession and enable others to make and use claimed aspects of the disclosure. The claimed disclosure should not be construed as being limited to any aspect, example, or detail provided in this application. Regardless of whether shown and described in combination or separately, the various features (both structural and methodological) are intended to be selectively included or omitted to produce an embodiment with a particular set of features. For instance, embodiments not shown but within the scope of the present disclosure include the use of helmet structure to provide the forehead portion and the occiput portion (e.g., a back portion) of the device. Multiple attachments can be added to such a helmet to create an outwardly extending lever arm with load attachment elements. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

What is claimed is:

1. A neck strengthening device, the device comprising:

a lower portion having a lever arm portion and a chin portion, wherein the lever arm extends outward from the chin portion;

a forehead component connected to the lower portion by at least one coupling member;

an occiput piece;

one or more straps used to connect the occiput piece to the lower portion;

one or more straps used to connect to the occiput piece to the forehead component; and one or more connection points associated with the lever arm for attaching a resistance force.

2. The neck strengthening device of claim 1 comprising at least two coupling members.

3. The neck strengthening device of claim 1 wherein the at least one coupling member is adjustable to accommodate different sized heads.

4. The neck strengthening device of claim 2 wherein the coupling members connect to the lower portion at a forward angle.

5. The neck strengthening device of claim 1 further comprising a recess area in the lower portion preventing contact with a neck of a user.

6. The neck strengthening device of claim 1 wherein the chin portion further comprises a depressed region wherein a chin of the user may contact the device.

7. The neck strengthening device of claim 6 further comprising:

a recess area in the lower portion preventing contact with a neck of a user; and a concave area in the forehead component for contact with a forehead of the user.

8. The neck strengthening device of claim 1 wherein lower portion, the forehead component and the one or more coupling members comprise one piece.

9. The neck strengthening device of claim 8 wherein the chin portion further comprises a depressed region wherein a chin of the user may contact the device.

10. The neck strengthening device of claim 9 further comprising:

a recess area in the lower portion preventing contact with a neck of a user; and a concave area in the forehead component for contact with a forehead of the user.

11. A method of strengthening a neck, the method comprising:

securing a neck strengthening device to a user, the user having a head, chin and forehead, the device comprising:

a lower portion, the lower portion comprising a lever arm and chin portion, the lever arm having one or more attachment points;

a forehead component connected to the chin portion by one or more braces;

one or more straps connected to the forehead component and the lower portion to secure the device to head of the user such that the forehead component is in contact with the forehead of the user, and the chin portion is in contact with the chin of the user;

applying an external load to one of the one or more attachment points;

counteracting the external load, by pulling the head backwards while simultaneously rotating the chin downward and back.

12. The method of claim 11 wherein the device further comprises at least two coupling members.

13. The method of claim 12 wherein the at least one coupling member is adjustable to accommodate different sized heads.

14. The method of claim 13 wherein the wherein the coupling members connect to the lower portion at a forward angle.

15. The method of claim 11 wherein the lower portion further comprises a recess area preventing contact with a neck of a user.

16. The method of claim 11 wherein the lower portion further comprises a depressed region.

17. The method of claim 11 wherein lower portion, the forehead component and the one or more coupling members comprise one piece.

18. The method of claim 17 wherein:

the chin portion further comprises a depressed region wherein a chin of the user may contact the device;

the lower portion further comprises a recess area preventing contact with a neck of a user; and the forehead component further comprises a concave area for contact with a forehead of the user.

* * * * *